US008582797B2

(12) United States Patent
Wang

(10) Patent No.: US 8,582,797 B2
(45) Date of Patent: Nov. 12, 2013

(54) PORTABLE ELECTRONIC DEVICE WITH A MAGNETIC-LOCKING SPEAKER

(75) Inventor: Chih-Yi Wang, Taipei Hsien (TW)

(73) Assignee: Wistron Corporation, Hsichih, New Taipei (TW)

( * ) Notice: Subject to any disclaimer, the term of this patent is extended or adjusted under 35 U.S.C. 154(b) by 1269 days.

(21) Appl. No.: 12/240,952

(22) Filed: Sep. 29, 2008

(65) Prior Publication Data

US 2009/0285429 A1 Nov. 19, 2009

(30) Foreign Application Priority Data

May 16, 2008 (TW) ..... 97118185 A

(51) Int. Cl.
*H04R 1/02* (2006.01)

(52) U.S. Cl.
USPC ..... 381/386; 381/117; 381/332; 381/387; 381/396; 381/400; 381/412

(58) Field of Classification Search
None
See application file for complete search history.

(56) References Cited

U.S. PATENT DOCUMENTS

| | | | | | |
|---|---|---|---|---|---|
| 1,944,583 | A * | 1/1934 | Sollic | 369/149 |
| 2,389,212 | A * | 11/1945 | Schwarz | 455/170.1 |
| 2,429,792 | A * | 10/1947 | Begun | 360/118 |
| 5,646,820 | A * | 7/1997 | Honda et al. | 361/679.6 |
| 6,661,650 | B2 * | 12/2003 | Nakajima et al. | 361/679.09 |
| 6,781,823 | B1 * | 8/2004 | Nyack | 361/679.29 |
| 2002/0158727 | A1 * | 10/2002 | Namen | 335/78 |
| 2002/0186530 | A1 * | 12/2002 | Nakajima et al. | 361/683 |
| 2004/0071308 | A1 * | 4/2004 | Guenther | 381/409 |
| 2006/0067557 | A1 * | 3/2006 | Imamura | 381/388 |
| 2008/0137880 | A1 * | 6/2008 | Mills et al. | 381/79 |
| 2009/0080684 | A1 * | 3/2009 | Groset et al. | 381/387 |
| 2009/0180660 | A1 * | 7/2009 | Groset et al. | 381/386 |
| 2009/0285429 | A1 * | 11/2009 | Wang | 381/332 |

FOREIGN PATENT DOCUMENTS

| | | | | |
|---|---|---|---|---|
| CN | 1725147 | A | 1/2006 | |
| JP | 08076884 | A * | 3/1996 | G06F 1/16 |
| TW | 373741 | | 11/1999 | |
| TW | 575274 | | 2/2004 | |

OTHER PUBLICATIONS

Office action mailed on Feb. 16, 2012 for the China application No. 200810108721.9, p. 3~7.

* cited by examiner

*Primary Examiner* — Marlon Fletcher
(74) *Attorney, Agent, or Firm* — Winston Hsu; Scott Margo

(57) ABSTRACT

A portable electronic device includes a housing. An opening is formed on the housing and a containing space is formed inside the housing. The portable electronic device further includes a speaker installed inside the containing space in a rotatable manner, a first magnetic component installed on a side of the speaker, a second magnetic component installed inside the housing and disposed on a side of the containing space for attracting the first magnetic component so as to position the first magnetic component on a first location, and a restoring component connected to the speaker for driving the speaker to rotate to a second location so as to expose the speaker outside the opening on the housing when magnetic attractive force between the first magnetic component and the second magnetic component disappears.

28 Claims, 6 Drawing Sheets

PORTABLE ELECTRONIC DEVICE WITH A MAGNETIC-LOCKING SPEAKER

BACKGROUND OF THE INVENTION

1. Field of the Invention

The present invention relates to a portable electronic device with a magnetic-locking speaker, and more particularly, to a portable electronic device with a magnetic-locking speaker capable of being positioned by magnetic force and elastic restoring force.

2. Description of the Prior Art

With progress of digital technology, portable electronic devices, such as notebook computers, PDAs, mobile phones, and MP3/MP4/WMA players, include multiple powerful functions. For example, most portable electronic devices have a function of playing music with an earphone or a built-in speaker. However, the conventional speaker of the portable electronic device can not have good sound quality due to limitation of volume and mechanical design. Additional, the speaker is always embedded inside a housing of the portable electronic device so that sound source can not direct to a user directly. It reduces the sound quality and can not achieve stereo effect unfortunately.

SUMMARY OF THE INVENTION

According to the claimed invention, a portable electronic device includes a housing. An opening is formed on the housing and a containing space is formed inside the housing. The portable electronic device further includes a speaker installed inside the containing space in a rotatable manner, a first magnetic component installed on a side of the speaker, a second magnetic component installed inside the housing and disposed on a side of the containing space for attracting the first magnetic component so as to position the first magnetic component on a first location, and a restoring component connected to the speaker for driving the speaker to rotate to a second location so as to expose the speaker outside the opening on the housing when magnetic attractive force between the first magnetic component and the second magnetic component disappears.

According to the claimed invention, a portable electronic device includes a housing. An opening is formed on the housing and a containing space is formed inside the housing. The portable electronic device further includes a speaker installed inside the containing space, a first magnetic component installed on a side of the speaker, a second magnetic component installed inside the housing and disposed on a side of the containing space for attracting or repulsing the first magnetic component, and a switch electrically connected to the first magnetic component for switching polarization of the first magnetic component or the second magnetic component so as to control the second magnetic component to attract or repulse the first magnetic component. The speaker is positioned on a first location when the second magnetic component attracts the first magnetic component, and the speaker exposes outside the containing space when the second magnetic component repulses the first magnetic component so as to drive the speaker to rotate to a second position relative to the second magnetic component.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
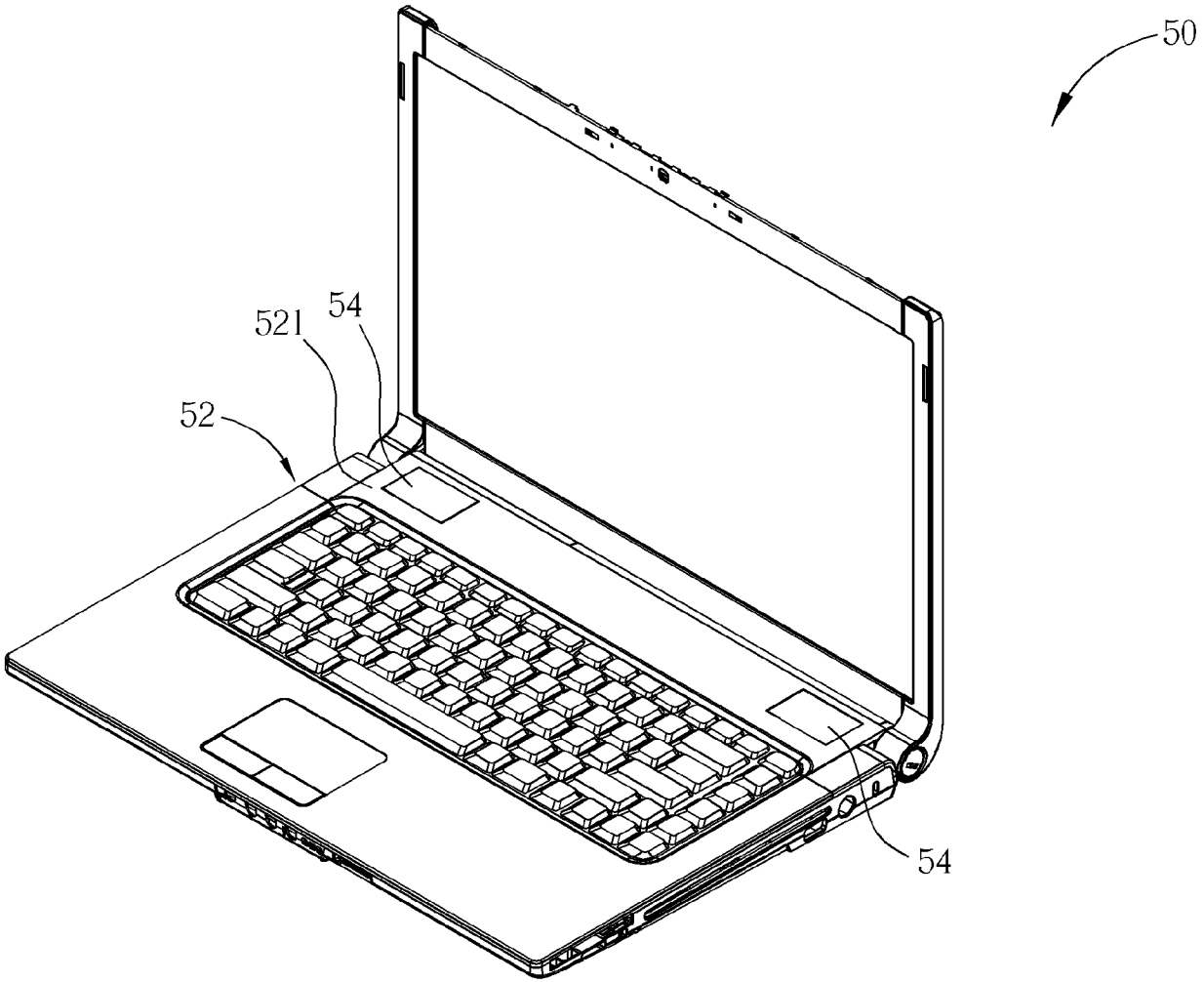
FIG. 1 is a schematic drawing of a portable electronic device according to a preferred embodiment of the present invention.

Please refer to FIG. 1. FIG. 1 is a schematic drawing of a portable electronic device 50 according to a preferred embodiment of the present invention. The portable electronic computer 50 can be a notebook computer. The portable electronic computer 50 includes a housing 50 having a surface 521. The portable electronic computer 50 further includes two speakers 54 disposed on both sides of the housing 52 respectively. The number and arrangement of the speakers 54 are not limited to the embodiment in FIG. 1 and can be designed according to demand.

Figure 2:
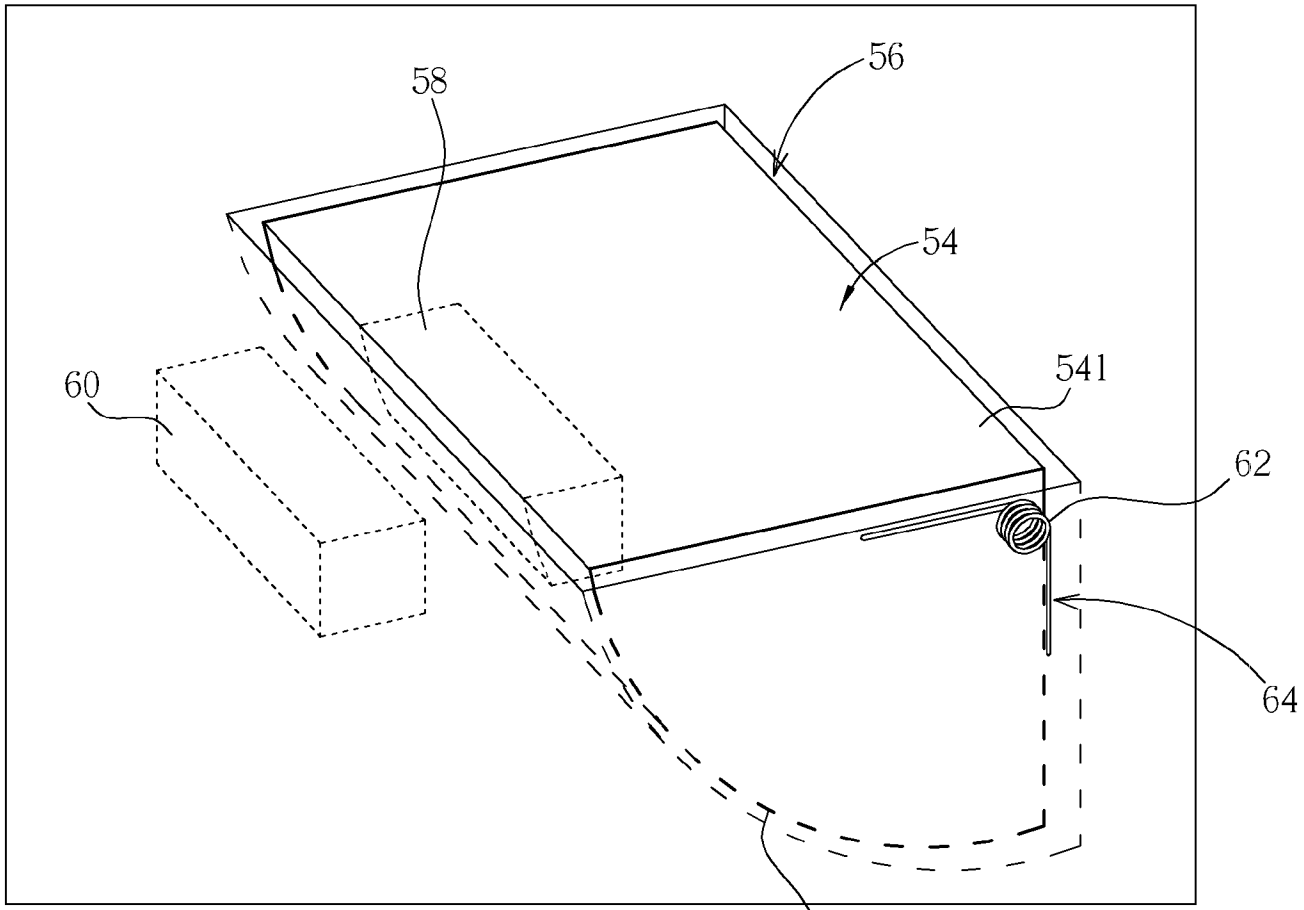
FIG. 2 is an internal diagram of a speaker installed inside a housing according to the preferred embodiment of the present invention.
Figure 3:
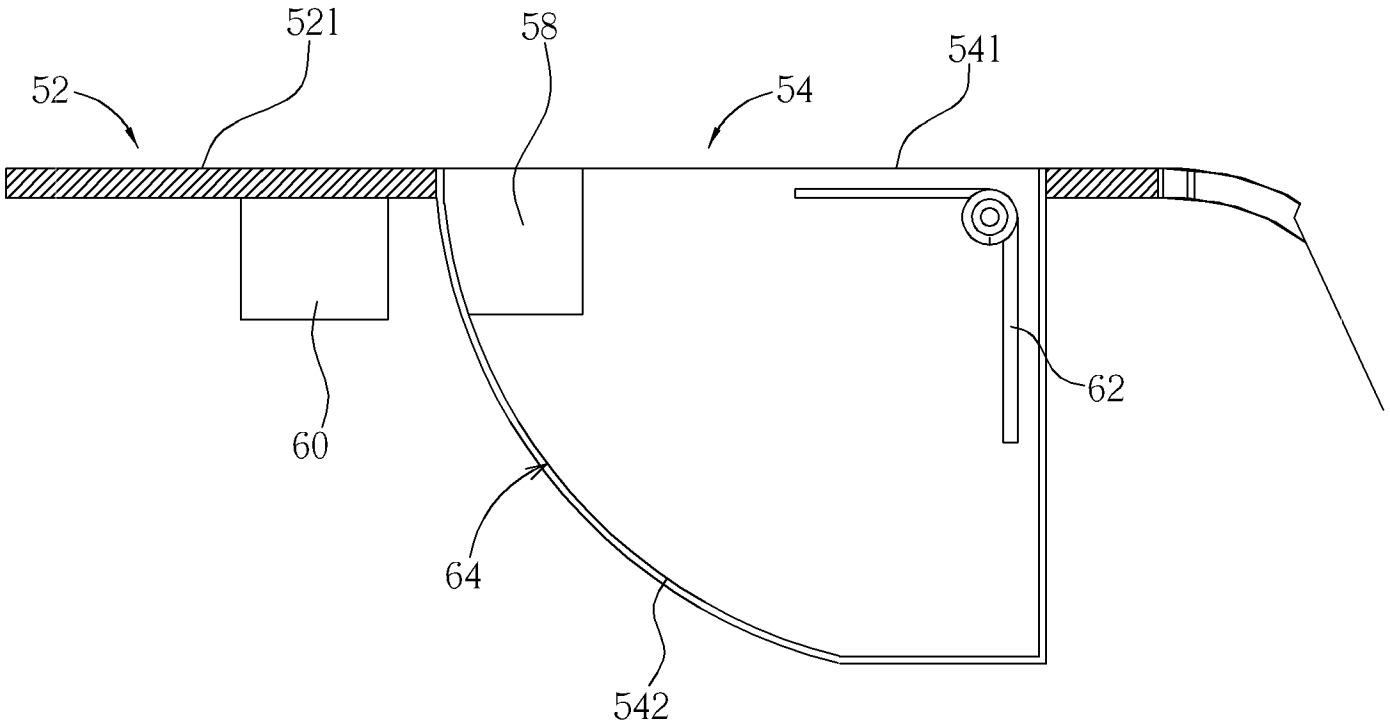
FIG. 3 is a lateral sectional view of the speaker positioned on a first location according to the preferred embodiment of the present invention.
Figure 4:
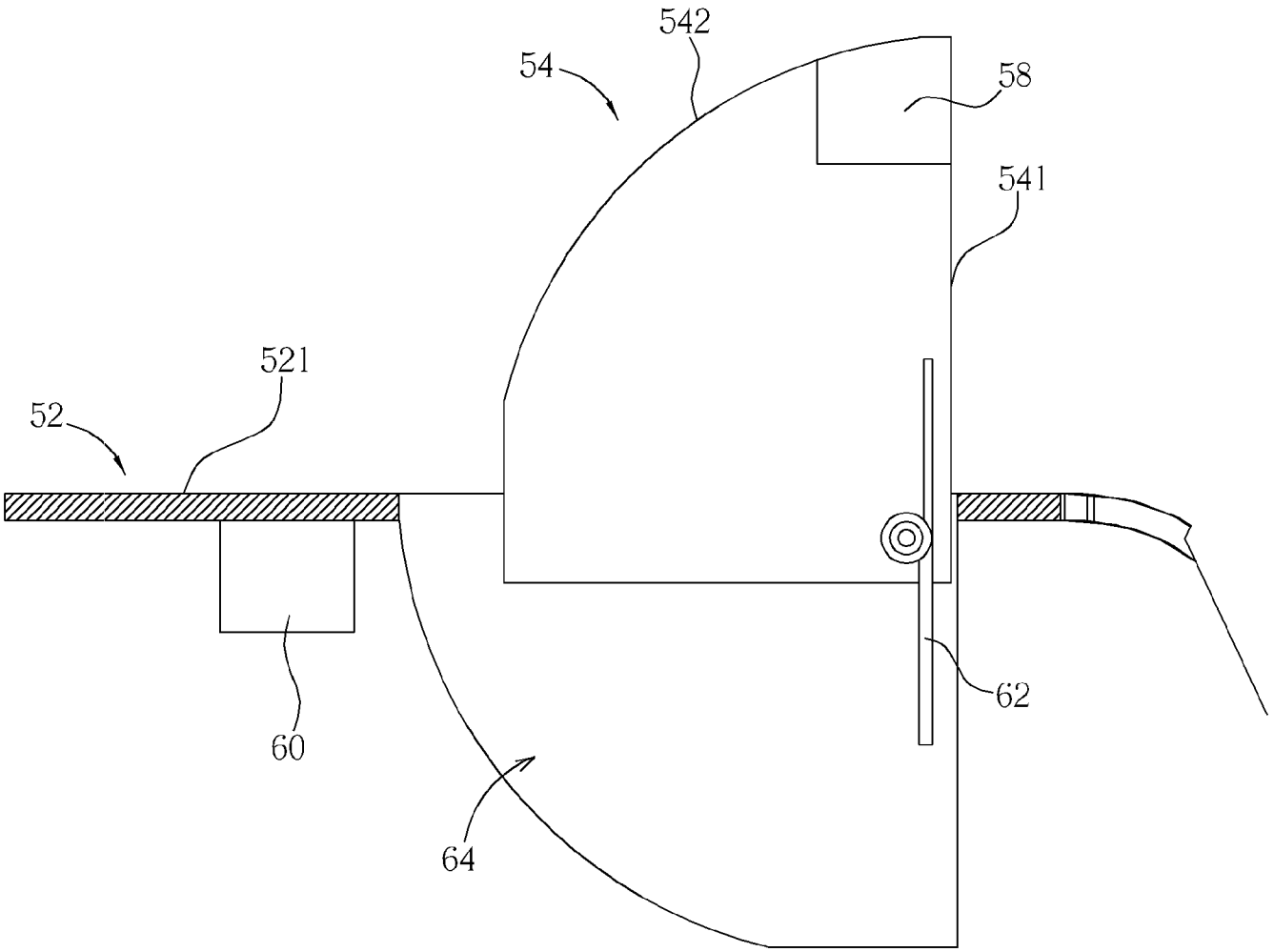
FIG. 4 is a lateral sectional view of the speaker positioned on a second location according to the preferred embodiment of the present invention.
Figure 5:
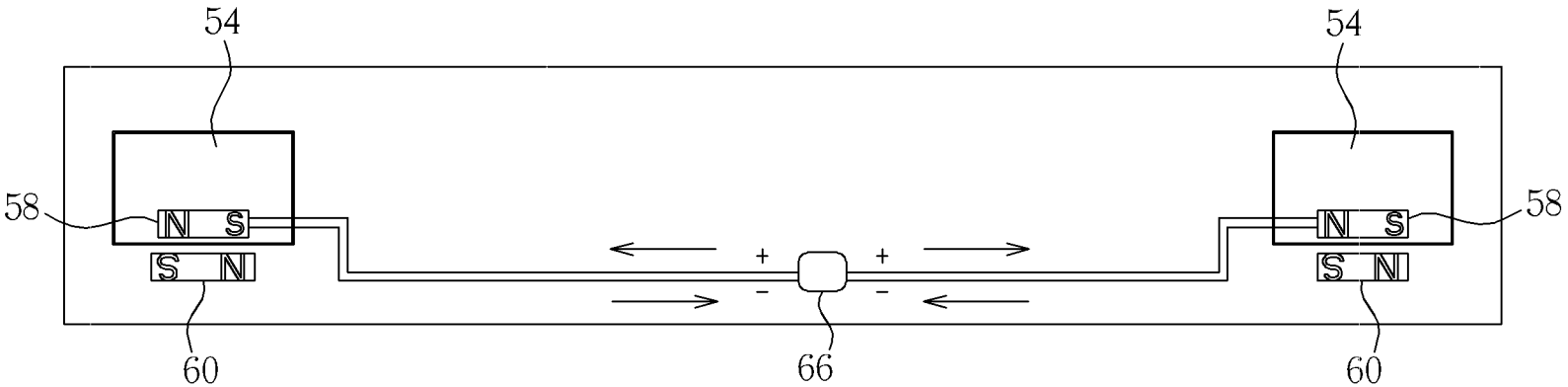
FIG. 5 is a functional block diagram of a switch for controlling the speakers according to the preferred embodiment of the present invention.

Please refer to FIG. 2 to FIG. 5. FIG. 2 is an internal diagram of the speaker 54 installed inside the housing 52 according to the preferred embodiment of the present invention. FIG. 3 is a lateral sectional view of the speaker 54 positioned on a first location according to the preferred embodiment of the present invention. FIG. 4 is a lateral sectional view of the speaker 54 positioned on a second location according to the preferred embodiment of the present invention. FIG. 5 is a functional block diagram of a switch for controlling the speakers 54 according to the preferred embodiment of the present invention. An opening 56 is formed on the surface 521 of the housing 52, and a containing space 64 is formed inside the housing 52. The speakers 54 are installed inside the containing space 64 in a rotatable manner. Each speaker 54 includes a lateral wall 541 and a chambered surface 542. The portable electronic device 50 further includes at least one first magnetic component 58 installed on an inner side of the chambered surface 542 of the speaker 54. The first magnetic component 58 can be an electromagnet. The portable electronic device 50 further includes at least one second magnetic component 60 installed inside the housing 52 and disposed on a side of the containing space 64 for attracting the first magnetic component 58 so as to position the speaker on the first position relative to the second magnetic component 60. The second magnetic component 60 can be a magnet, such as a permanent magnet. The portable electronic device 50 further includes a restoring component 62 connected to the speaker 54 for driving the speaker 54 to rotate to the second location from the first position so as to expose the speaker 54 outside the opening 56 on the housing 52 when magnetic attractive force between the first magnetic component 58 and the second magnetic component 60 disappears. The restoring component 62 can be an elastic component, such as a torsional spring, a prestressing spring, and so on.

Please refer to FIG. 5. The portable electronic device 50 further includes a switch 66. The switch 66 is electrically connected to the first magnetic component 58 (electromagnet) for switching the first magnetic component 58 (electromagnet) to be electrified or diselectrified. The switch 66 can be a button so that the user can press the button to switch the first magnetic component 58 to be electrified or diselectrified. For example, the user can press the switch to electrify or diselectrify the first magnetic component 58. Additionally, the switch 66 can be integrated with other mechanism. For example, the switch 66 can be turn on/turn off when a screen or the speaker 54 of the portable electronic device 50 is open/close or the speaker 54 is pressed to the first position from the second position.

When the first magnetic component 58 is switched to be electrified by the switch 66, the first magnetic component 58 generates an electromagnetic field opposite to the polarization of the second magnetic component 60 as shown in FIG. 5 so that the first magnetic component 58 is capable of attracting the second magnetic component 60 and the speaker 54 can be fixed on the first position as shown in FIG. 3. At this time, the lateral wall 541 of the speaker 54 and the surface 521 of the housing 52 are at the same level substantially, and the speaker 54 is contained inside the containing space 64 completely so as to keep uniformity of an outline of portable electronic device 50 and to protect the speaker from collision and dust. The user can control the switch 66 to switch the first magnetic component 58 to be diselectrified so that the electromagnetic field generated by the first magnetic component 58 disappears. The restoring component 62 can drive the speaker 54 to jump outside the housing 52 by prestressing force from the first position to the second location as shown in FIG. 4 so as to expose the speaker 54 outside the opening 56 on the housing 52 when magnetic attractive force between the first magnetic component 58 and the second magnetic component 60 disappears. At this time, the lateral wall 541 of the speaker 54 is perpendicular to the surface 521 of the housing 52 substantially when the speaker is positioned on the second location relative to the second magnetic component 60 so that the speaker 54 can direct to the user directly. It increases the sound quality and achieves stereo effect. Additionally, the polarization of the first magnetic component 58 can be switched by the switch 66 according to another embodiment of the present invention. For example, the polarization of the electromagnetic field generated by the first magnetic component 58 can be opposite to the polarization of the second magnetic component 60 so that the first magnetic component 58 is capable of attracting the second magnetic component 60 and the speaker 54 can be fixed on the first position as shown in FIG. 3 when turning on the switch 66. Accordingly, the polarization of the electromagnetic field generated by the first magnetic component 58 can be the same as the polarization of the second magnetic component 60 so that the first magnetic component 58 is capable of repulsing the second magnetic component 60 and the speaker 54 can rotate to the second position as shown in FIG. 4 by repulsive force between the first magnetic component 58 and the second magnetic component 60 or restoring force provided by the restoring component 62 when turning off the switch 66. On the contrary, the polarization of the electromagnetic field generated by the first magnetic component 58 can be opposite to the polarization of the second magnetic component 60 so that the first magnetic component 58 is capable of attracting the second magnetic component 60 and the speaker 54 can be fixed on the first position as shown in FIG. 3 when turning off the switch 66. Accordingly, the polarization of the electromagnetic field generated by the first magnetic component 58 can be the same as the polarization of the second magnetic component 60 so that the first magnetic component 58 is capable of repulsing the second magnetic component 60 and the speaker 54 can rotate to the second position as shown in FIG. 4 by repulsive force between the first magnetic component 58 and the second magnetic component 60 or restoring force provided by the restoring component 62 when turning on the switch 66.

Figure 6:
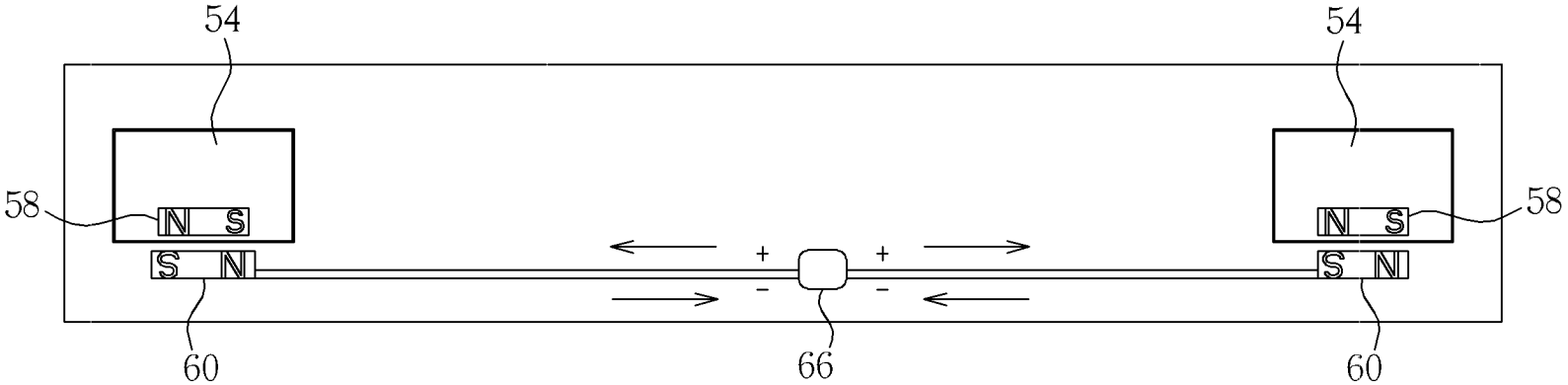
FIG. 6 is a functional block diagram of a switch for controlling the speakers according to another preferred embodiment of the present invention.

Please refer to FIG. 6. FIG. 6 is a functional block diagram of a switch for controlling the speakers 54 according to another preferred embodiment of the present invention. The difference between this embodiment and the above-mentioned embodiment is that the second magnetic component 60 is an electromagnet and the first magnetic component 58 is a magnet, such as a permanent magnet. The switch 66 is electrically connected to the second magnetic component 60 (electromagnet) for switching the second magnetic component 60 (electromagnet) to be electrified or diselectrified. When the second magnetic component 60 is switched to be electrified by the switch 66, the second magnetic component 60 generates an electromagnetic field opposite to the polarization of the first magnetic component 58 as shown in FIG. 6 so that the second magnetic component 60 is capable of attracting the first magnetic component 58 and the speaker 54 can be fixed on the first position as shown in FIG. 3. The user can control the switch 66 to switch the second magnetic component 60 to be diselectrified so that the electromagnetic field generated by the second magnetic component 60 disappears. The restoring component 62 can drive the speaker 54 to jump outside the housing 52 by prestressing force from the first position to the second location as shown in FIG. 4 so as to expose the speaker 54 outside the opening 56 on the housing 52 when magnetic attractive force between the first magnetic component 58 and the second magnetic component 60 disappears. Additionally, the polarization of the second magnetic component 60 can be switched by the switch 66 according to another embodiment of the present invention. For example, the polarization of the electromagnetic field generated by the second magnetic component 60 can be opposite to the polarization of the first magnetic component 58 so that the second magnetic component 60 is capable of attracting the first magnetic component 58 and the speaker 54 can be fixed on the first position as shown in FIG. 3 when turning on the switch 66. Accordingly, the polarization of the electromagnetic field generated by the second magnetic component 60 can be the same as the polarization of the first magnetic component 58 so that the second magnetic component 60 is capable of repulsing the first magnetic component 58 and the speaker 54 can rotate to the second position as shown in FIG. 4 by repulsive force between the first magnetic component 58 and the second magnetic component 60 or restoring force provided by the restoring component 62 when turning off the switch 66. On the contrary, the polarization of the electromagnetic field generated by the second magnetic component 60 can be opposite to the polarization of the first magnetic component 58 so that the second magnetic component 60 is capable of attracting the first magnetic component 58 and the speaker 54 can be fixed on the first position as shown in FIG. 3 when turning off the switch 66. Accordingly, the polarization of the electromagnetic field generated by the second magnetic component 60 can be the same as the polarization of the first magnetic component 58 so that the second magnetic component 60 is capable of repulsing the first magnetic component 58 and the speaker 54 can rotate to the second position as shown in FIG. 4 by repulsive force between the first magnetic component 58 and the second magnetic component 60 or restoring force provided by the restoring component 62 when turning on the switch 66.

In conclusion, the present invention utilizes change of the polarization of the electromagnet for fixing the speaker inside the housing or for exposing the speaker outside the housing. Any mechanical design of changing the polarization of the electromagnet for positioning the speaker is within the scope of the present invention.

In contrast to the prior art, the portable electronic device of the present invention utilizes magnetic force and elastic restoring force to open or close the speaker thereof. When not using the speaker, the speaker can be contained inside the housing so as to keep uniformity of the outline of the portable electronic device and to protect the speaker from collision and dust. When using the speaker, the speaker can be lifted to direct to the user directly so as to increase the sound quality and to achieve stereo effect.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A portable electronic device comprising:

a housing, an opening being formed on the housing and a containing space being formed inside the housing;

a speaker installed inside the containing space in a rotatable manner;

a first magnetic component installed on a side of the speaker;

a second magnetic component installed inside the housing and disposed on a side of the containing space for attracting the first magnetic component so as to position the first magnetic component on a first location; and a restoring component connected to the speaker for driving the speaker to rotate to a second location so as to expose the speaker outside the opening on the housing when magnetic attractive force between the first magnetic component and the second magnetic component disappears.

2. The portable electronic device of claim 1 wherein the first magnetic component is an electromagnet for attracting the second magnetic component when being electrified.

3. The portable electronic device of claim 2 further comprising a switch electrically connected to the electromagnet for switching the electromagnet to be electrified or diselectrified.

4. The portable electronic device of claim 2 wherein the second magnetic component is a magnet.

5. The portable electronic device of claim 1 wherein the second magnetic component is an electromagnet for attracting the first magnetic component when being electrified.

6. The portable electronic device of claim 5 further comprising a switch electrically connected to the electromagnet for switching the electromagnet to be electrified or diselectrified.

7. The portable electronic device of claim 5 wherein the first magnetic component is a magnet.

8. The portable electronic device of claim 1 wherein the restoring component is an elastic component.

9. The portable electronic device of claim 8 wherein the elastic component is a torsional spring.

10. The portable electronic device of claim 8 wherein the elastic component is a prestressing spring.

11. The portable electronic device of claim 1 wherein the speaker is contained inside the containing space completely when the speaker is positioned on the first location relative to the second magnetic component.

12. The portable electronic device of claim 11 wherein a lateral wall of the speaker and a surface of the housing are at the same level substantially when the speaker is positioned on the first location relative to the second magnetic component.

13. The portable electronic device of claim 1 wherein the speaker completely exposes outside the opening on the housing substantially when the speaker is positioned on the second location relative to the second magnetic component.

14. The portable electronic device of claim 13 wherein a lateral wall of the speaker is perpendicular to a surface of the housing substantially when the speaker is positioned on the second location relative to the second magnetic component.

15. The portable electronic device of claim 1 wherein the side of the speaker is a chambered surface.

16. The portable electronic device of claim 1 being a notebook computer.

17. A portable electronic device comprising:

a housing, an opening being formed on the housing and a containing space being formed inside the housing;

a speaker installed inside the containing space;

a first magnetic component installed on a side of the speaker;

a second magnetic component installed inside the housing and disposed on a side of the containing space for attracting or repulsing the first magnetic component; and a switch electrically connected to the first magnetic component for switching polarization of the first magnetic component or the second magnetic component so as to control the second magnetic component to attract or repulse the first magnetic component;

wherein the speaker is positioned on a first location when the second magnetic component attracts the first magnetic component, and the speaker exposes outside the containing space when the second magnetic component repulses the first magnetic component so as to drive the speaker to rotate to a second position relative to the second magnetic component.

18. The portable electronic device of claim 17 wherein the first magnetic component or the second magnetic component is an electromagnet.

19. The portable electronic device of claim 17 further comprising a restoring component connected to the speaker for driving the speaker to rotate to the second location when the second magnetic component repulses the first magnetic component.

20. The portable electronic device of claim 19 wherein the restoring component is an elastic component.

21. The portable electronic device of claim 20 wherein the elastic component is a torsional spring.

22. The portable electronic device of claim 20 wherein the elastic component is a prestressing spring.

23. The portable electronic device of claim 17 wherein the speaker is contained inside the containing space completely when the speaker is positioned on the first location relative to the second magnetic component.

24. The portable electronic device of claim 17 wherein a lateral wall of the speaker and a surface of the housing are at the same level substantially when the speaker is positioned on the first location relative to the second magnetic component.

25. The portable electronic device of claim 17 wherein the speaker completely exposes outside the opening on the housing substantially when the speaker is positioned on the second location relative to the second magnetic component.

26. The portable electronic device of claim 25 wherein a lateral wall of the speaker is perpendicular to a surface of the housing substantially when the speaker is positioned on the second location relative to the second magnetic component.

27. The portable electronic device of claim 17 wherein the side of the speaker is a chambered surface.

28. The portable electronic device of claim 17 being a notebook computer.

* * * * *